US005317238A

United States Patent [19]

Schaedel

[11] Patent Number: 5,317,238

[45] Date of Patent: May 31, 1994

[54] ELECTROMAGNETIC FIELD SENSITIVE ANIMATED ORNAMENTAL DISPLAY

[76] Inventor: Richard Schaedel, 872 Lovell Ave., Mill Valley, Calif. 94941

[21] Appl. No.: 772,170

[22] Filed: Oct. 7, 1991

[51] Int. Cl.[5] ..... H05B 37/00

[52] U.S. Cl. ..... 315/323; 315/360; 315/200 A; 315/161; 315/320; 315/210; 362/800

[58] Field of Search ..... 362/800; 315/248, 312, 315/323, 200 A, 291, 294, 297, 176, 161, 344, 152, 153, 154, 360, 159, 320, 210

[56] References Cited

U.S. PATENT DOCUMENTS

| | | | |
|---|---|---|---|
| 2,268,870 | 1/1942 | Greenlee | 315/248 |
| 3,911,423 | 10/1975 | Arndt et al. | 315/153 |
| 4,264,845 | 4/1981 | Bednarz | 362/800 |
| 4,445,132 | 4/1984 | Ichikawa et al. | 357/32 |
| 4,686,425 | 8/1987 | Havel | 315/152 |
| 4,870,325 | 9/1989 | Kazar | 315/178 |
| 5,008,595 | 4/1991 | Kazar | 315/178 |

FOREIGN PATENT DOCUMENTS

| | | | |
|---|---|---|---|
| 1328419 | 8/1973 | United Kingdom | 315/312 |

*Primary Examiner*—Robert J. Pascal
*Assistant Examiner*—Michael B. Shingleton
*Attorney, Agent, or Firm*—Howard Cohen

[57] ABSTRACT

An electronic display for amusement or ornamentation includes a CMOS counter chip connected to a low voltage DC source, with each counter output connected directly to one of a plurality of LEDs. An antenna wire, which can be a short length of wire or a wire hook is connected directly to the trigger input of the chip, and the ambient field-induced AC voltage on the antenna is sufficient to actuate the counter chip and cause the LEDs to flicker sequentially as the counter outputs are incremented. The LEDs may be embodied in a wide variety of decorative arrays to represent objects, images, and icons. The visual effect is not monotonous, due to the natural variations of the ambient field about the ornament. The invention also comprises a Christmas tree light assembly, including a plurality of ornaments, each constructed as described and including a hook-shaped antenna wire for hanging on a Christmas tree. Each ornament may be powered by an individual battery included therein. Alternatively, the invention provides a transformer/rectifier power supply with an input connected to utility power and 3–9 VDC output connected to a cable which is hung about the Christmas tree. Each ornament may be wired or plug-connected to the cable, and the individual batteries for each ornament may be eliminated. The antennae of the ornaments may be triggered by ambient electromagnetic fields; alternatively, the power cable may be provided with a trigger wire that carries a low voltage, induction-coupled signal trigger signal to all the ornaments.

8 Claims, 4 Drawing Sheets

ELECTROMAGNETIC FIELD SENSITIVE ANIMATED ORNAMENTAL DISPLAY

BACKGROUND OF THE INVENTION

In recent years the availability of inexpensive LEDs in an increasing variety of colors, brightness, and size has led to the development of LED displays for purposes of amusement or ornamentation. For example, earrings, necklaces, pendants, headbands, hats, blouses and shirts have been adorned with LED displays powered by small portable batteries. Often the LEDs are driven by a simple oscillator circuit to switch on and off and attract the attention of the casual observer. Generally, these devices are limited to small-scale displays.

LEDs have also been used for other forms of minilight style ornamental display, such as Christmas tree light strings, LED illumination for doll houses and miniatures, and the like. Often these devices are driven by complex circuitry that generates an oscillating signal to switch the LEDs off and on at various rates, as well as to combine the discrete colors of various LEDs to create the illusion of a wide range of colors. Although these devices are successful in creating the desired amusement displays, they generally involve many kinds of integrated circuit chips and other electronic components to generate the oscillator frequency.

An unused source of oscillator frequencies for light displays exists in the invisible fields surrounding AC lines and equipment. There are at present several AC voltage sensors commercially available which use a CMOS hex inverter to activate a single LED and a speaker. These circuits attach an antenna to one of the six possible inputs to the inverter and add capacitors and resistors to modulate the pulse. These circuits are functional only as test instruments and have no ornamental value. In addition to the ornamental and visible timing features of the present invention, there is the additional advantage of a built-in ON indicator. In the battery operated mode, the circuit will always have one LED illuminated when the device is not receiving an electromagnetic field signal. All of the LEDs are driven to flicker when the device receives an EMF signal.

SUMMARY OF THE PRESENT INVENTION

The present invention generally comprises a novel electronic display for amusement or ornamentation. A salient feature of the invention is that the displays may be made in any of a multitude of decorative representations, using patterns of a multitude LEDs as the active display elements. Another salient feature of the invention is that the LEDs of each display ornament is not connected to an internal oscillator; rather, each ornament incorporates a circuit that is sensitive to ambient electromagnetic fields, and is driven by the ambient fields to drive the LEDs at the frequency of the ambient fields. Thus the display oscillation can be designed to be random or sequential, providing an effect that attracts attention and is more pleasing than a fixed frequency oscillation. Moreover, the electromagnetic field sensitive circuit comprises a simple CMOS chip, with no additional circuitry, so that the display is simple and inexpensive. Another advantage of the invention is that educational and informative, in that the display will illuminate and flicker only in the presence of otherwise invisible fields caused by AC power lines and the like.

Each ornament of the invention includes a CMOS counter chip, such as the 4017 integrated circuit decade counter known in the prior art. The chip is connected to a low voltage DC power source, such as a battery or a rectified power supply providing 3–12 VDC. The counter outputs of the integrated circuit are each connected directly to one of a plurality of LEDs. An antenna, which can be a short length of wire, a wire hook, a telescoping tube, or the like, is connected directly to one of two possible trigger inputs of the chip, and the field-induced AC voltage on the antenna is sufficient to actuate the counter chip and cause the LEDs to flicker according to the designed pattern as the counter outputs are incrementally actuated.

The LEDs may be embodied in a wide variety of decorative arrays to represent objects, images, and icons. For example, the LEDs may be arrayed about the perimeter of a heart shaped base to form a pendant, earring, or ornament, especially appropriate as a Valentine's Day gift, Christmas tree ornament, or the like. The LEDs, which may be of uniform or various colors and sizes, may be arranged to be lighted sequentially about the periphery of the ornament, or may be arranged so that the illumination appears to be random. In either case, the visual effect is not monotonous, due to the random or designed spacial sequencing of the LEDs in the ornament. Other ornamental representations include, but are not limited to, a Christmas tree, a golden ring, a bell, a Santa Claus face, a jack-in-the-box, a fish or other animals, a wreath, a closed loop, a plant sculpture, a combination of letters or numbers representing a personal monogram, corporate logo, or the like. The size of the device can be reduced to conform to a finger ring, business card, or earring, or made very large to comprise a commercial display sign or the like.

Other CMOS counter/display driver integrated circuits may also be employed in the present invention. For example, the 4022 divide by 8 counter chip may be used as described above, with the trigger lead connected to an antenna lead, 3–12 VDC connected to the power input lead, and the segment driver output terminals each connected to LED display segments. Likewise, a 40110 CMOS integrated circuit display driver may be used in the same manner, with the trigger input connected to an antenna lead and the outputs connected to an alphanumeric display, to form a random number generator for visual amusement and number generation for games of chance.

In another aspect of the present invention, there is provided a plurality of ornaments, constructed as described above and each including a hook-shaped antenna wire for hanging each ornament on a Christmas tree. Each ornament may be powered by an individual battery included therein, and disposed to receive the EMF signal of an incandescent light string hung on the tree. Alternatively, the invention provides a transformer/rectifier power supply with an input connected to utility power and 3–12 VDC output connected to a cable which is hung about the Christmas tree. Each ornament may be either wired or plug-connected to the cable, and the individual batteries for each ornament may be eliminated. The antennae of the ornaments are triggered by the electromagnetic fields induced in the DC supply line by the transformer/rectifier power supply.

It should be noted that the present invention employs a CMOS integrated circuit to drive the associated LEDs, and that no other electronic components (resistors, capacitors, transistors, inductors) are required.

Thus component cost and labor cost are reduced to an absolute minimum.

It may be appreciated that the Christmas tree ornament assembly delivers only low voltage, low power electrical signals to the cable and ornaments which adorn the tree, so that the risk of fire and shock hazard is virtually eliminated.

DESCRIPTION OF THE PREFERRED EMBODIMENT

Figure 1A:
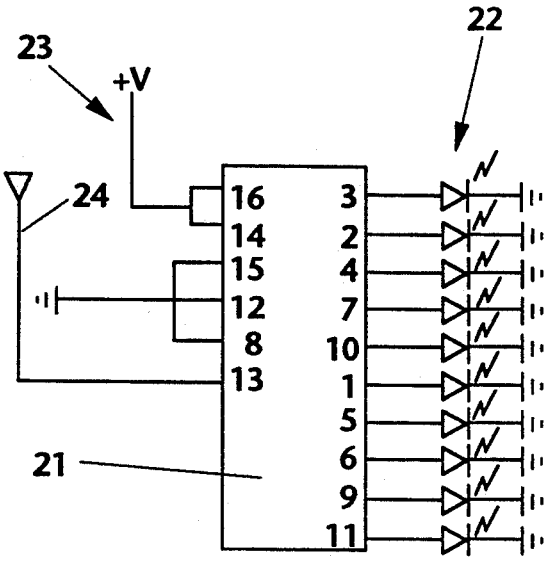
FIGS. 1*a* to 1*b* are schematic representations of two similarly forms of the electromagnetic field sensitive ornament of the present invention.

The present invention generally comprises a novel electronic display for amusement or ornamentation that creates random visual effects which are pleasing and attractive. A significant aspect of the invention is the use of LEDs as a light source and the simplicity of the circuitry used to drive the LEDs. With regard to FIG. 1, the circuit embodied in each display includes an integrated circuit 21, which comprises a CMOS counter circuit. Examples of such an integrated circuit are a 4017 decade counter, a 4022 divide by 8 counter, or any related CMOS integrated circuit. The voltage input pins 14 and 16 are connected to a source of 3–12 VDC, and the pins 8, 12, and 15 are connected to ground, as shown in FIG. 1*a*. (Pin 12 can be connected to ground, to another LED, or to the trigger input of another integrated circuit 21 to form a cascade counter display. Pin 15 is the reset pin and can be tied to an output to form a divide by 10 counter.) All of the counter output terminals 1–7 and 9–11 are each connected to one of a plurality of LEDs 22. The LEDs may exhibit any of the many colors available, may be of any size that is known in the art, and may be arrayed in any form or arrangement deemed to be appropriate for the intended display format.

A key feature of the invention is that the trigger input lead 13 is connected directly to an antenna conductor 24 which extends a short distance (on the order of 1–20 cm) from the integrated circuit 21. The antenna is arranged to be disposed in the ambient electromagnetic field surrounding the integrated circuit 21. Such fields are commonly generated by utility wiring and home wiring, electrical motors and appliances, electronic devices, and the like. The ambient fields induce a small AC voltage (in the microvolt to millivolt range) in the antenna conductor 24, and this voltage is sufficient to trigger the sensitive CMOS counter circuit and actuate the counter output leads. The leads are actuated sequentially by the circuit, and the LEDs are likewise illuminated briefly and sequentially as the counter circuit is incremented by the trigger input voltage. The rate of the counter actuation is generally equal to the frequency of the induced trigger voltage. If the ambient field source is a utility power line, the resulting trigger rate is 50 or 60 Hz, depending on the country, and each LED will flicker in sequence 5 or 6 times per second.

Figure 1B:
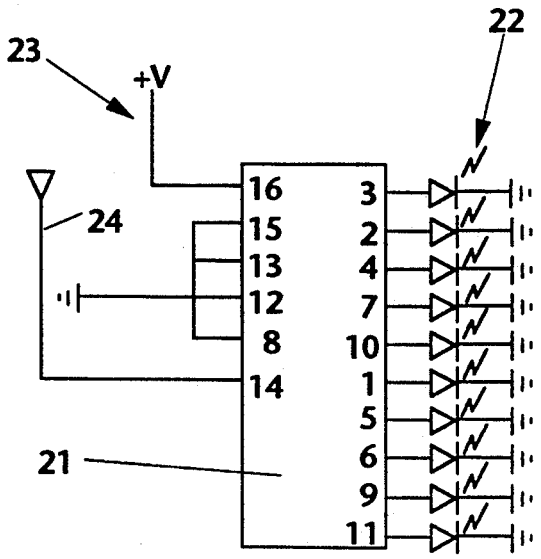

Alternatively, as shown in FIG. 1*b*, the lead 14 may be connected to the antenna 24, and pin 13 may be grounded, and the operation of the circuit is the same as described above. In either case, one LED is illuminated in the absence of an EMF signal from the antenna 24, and this one LED comprises an ON indicator for the circuit.

CMOS circuits are notorious for their sensitivity to impressed voltages from ambient fields, and the common wisdom in electronic engineering is that the associated circuitry must be designed to protect the CMOS integrated circuit from unwanted noise and triggering from such voltages. In contravention to the common wisdom, the present invention takes advantage of the CMOS sensitivity to ambient fields to form a free-running oscillator which uses no ancillary circuit components. As a result, the circuit of the present invention is as inexpensive as is possible for an oscillating LED driver which operates each of a plurality of LEDs individually.

Due to the simplicity of the circuit, the small size of the CMOS circuit 21, and the availability of a wide range of very small portable power sources in the 3–12 VDC range, the display of the present invention may be embodied in a wide range of miniature or larger size ornaments. For example, the circuit and silver cell power source can be mounted in a small ring to be worn about a finger, and the LEDs may be arrayed on the outer face of the ring. Likewise, earrings, pendants, brooches, spectacle frames, watch bezels, key rings, toys, wallet-size cards, and the like may embody the display of the present invention. As a further alternative, the display device may be used as a lighted ornament for a Christmas tree.

The LEDs, together with indicia or artistic blandishments, may be used to create a wide variety of representations of objects, characters, icons, figures, logos, and designs. For example, with regard to FIG. 3, the device may be formed to represent a heart 31, or a Christmas tree 32, a bell 33, a Santa Claus face 34, a jack-in-the-box 37, a fish 37, a ring or wreath 38, a candy cane 39, and an alphanumeric display 41. Other designs and representations may be apparent to the skilled artisan.

Figure 2:
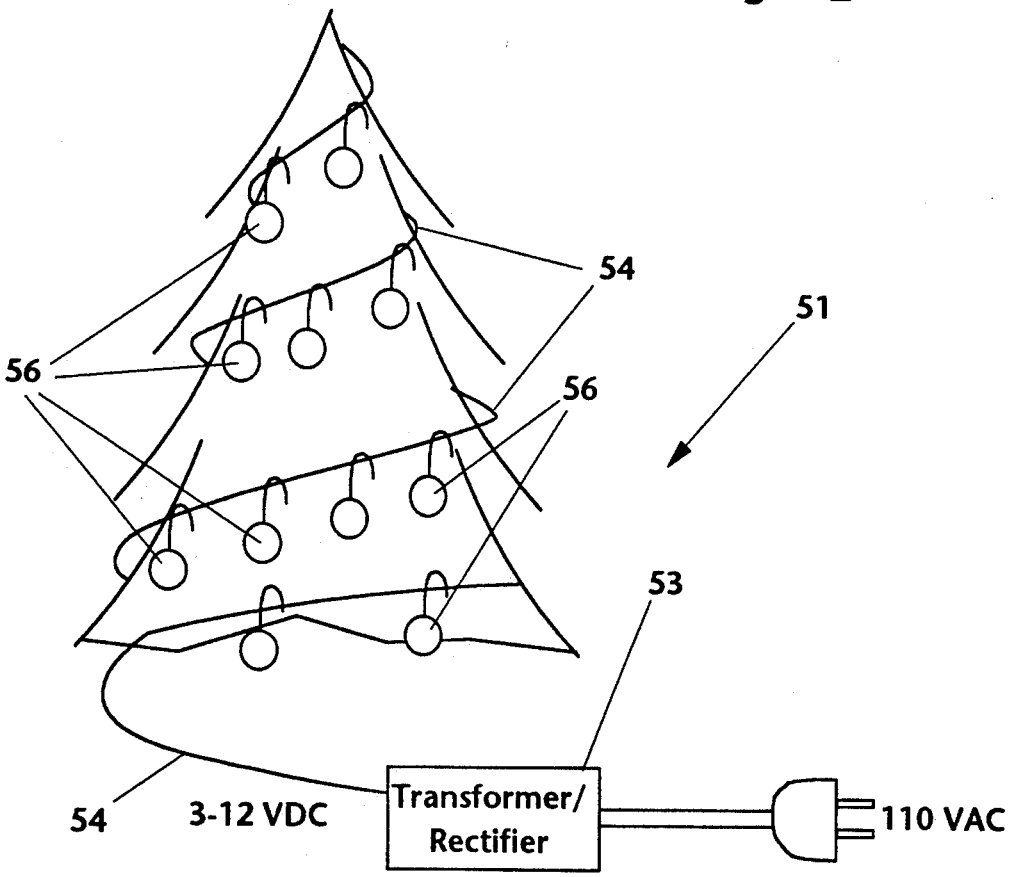
FIG. 2 is a block diagram representation of the Christmas tree light assembly of the present invention.
Figure 3:
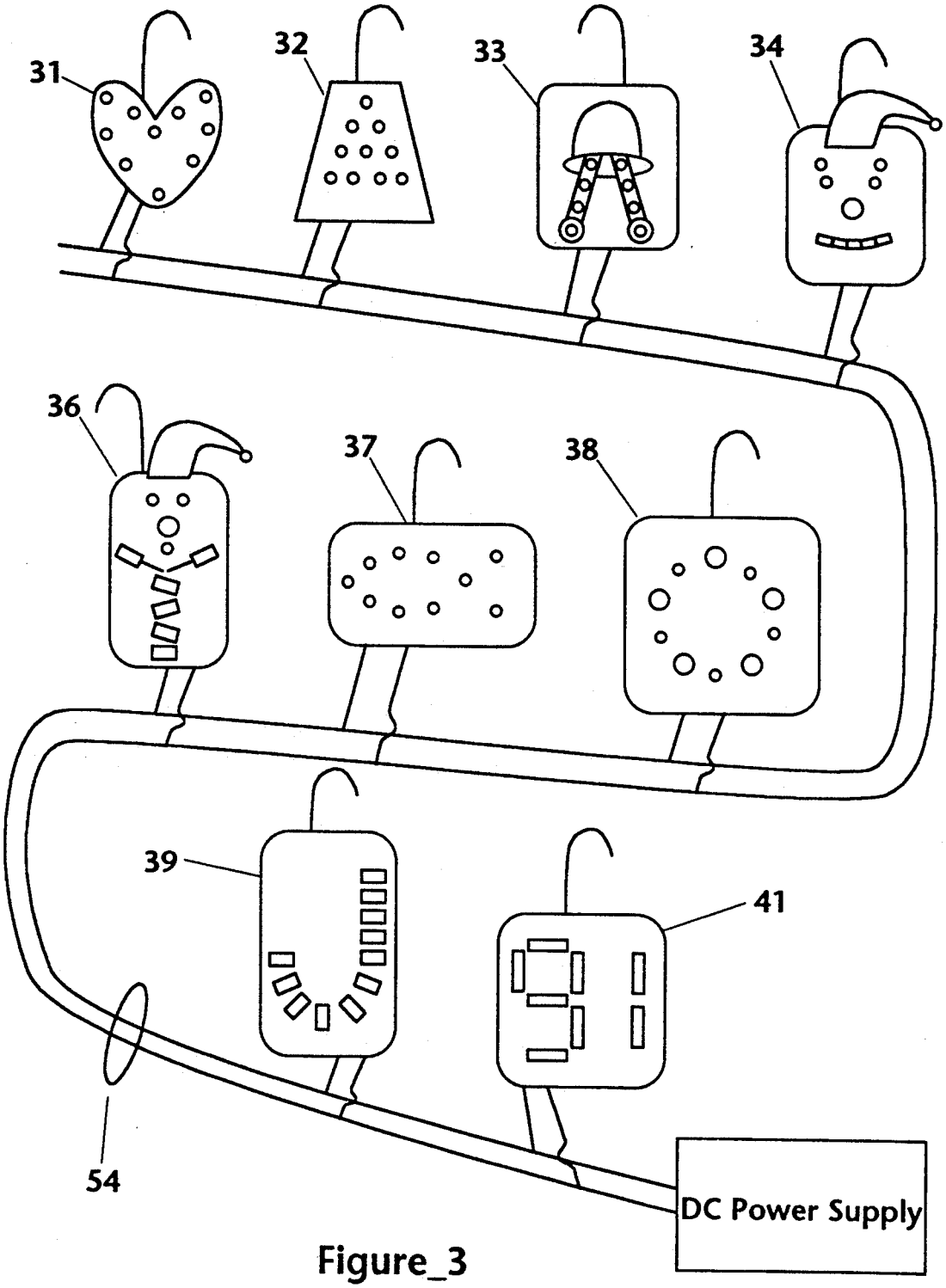
FIG. 3 is a composite view of a plurality of different display ornaments made in accordance with the present invention.

A further embodiment of the invention, shown in FIG. 2, comprises a Christmas tree ornamental lighting system 51. The system includes a transformer/rectifier power supply adapted to generate 3–12 VDC which is connected to a cable 54 sufficient in length to be extended about the Christmas tree. A plurality of ornaments 56, constructed as described with reference to FIGS. 1 and 3, are disposed to hang from the branches of the tree. Each ornament includes an antenna that is hook shaped to facilitate hanging from the cable. Each ornament may be wired or plug-connected to the cable to be powered thereby and produce a pleasing light display. As described previously, the LEDs of each ornament are arrayed to be triggered to flicker sequentially or randomly within the ornament display, according to the ambient fields which impinge on the respective ornaments, so that the ornament triggering will appear individualized, in contrast to the unitary flashing of most Christmas tree light strings. The pattern and connections of the LED arrays determine that sequences can progress clockwise or counterclockwise, or randomly, or linearly in various directions to achieve effects unique to each ornament.

The transformer/rectifier power supply is preferably a variable output device in the 3-12 VDC range, as is known in the prior art, so that the voltage supplied to the LEDs may be selectively varied to vary the brightness of the LEDs output. Moreover, it is significant that the only power source in the vicinity of the tree is the low voltage cable, which poses neither a shock hazard nor a fire hazard.

Figure 5:
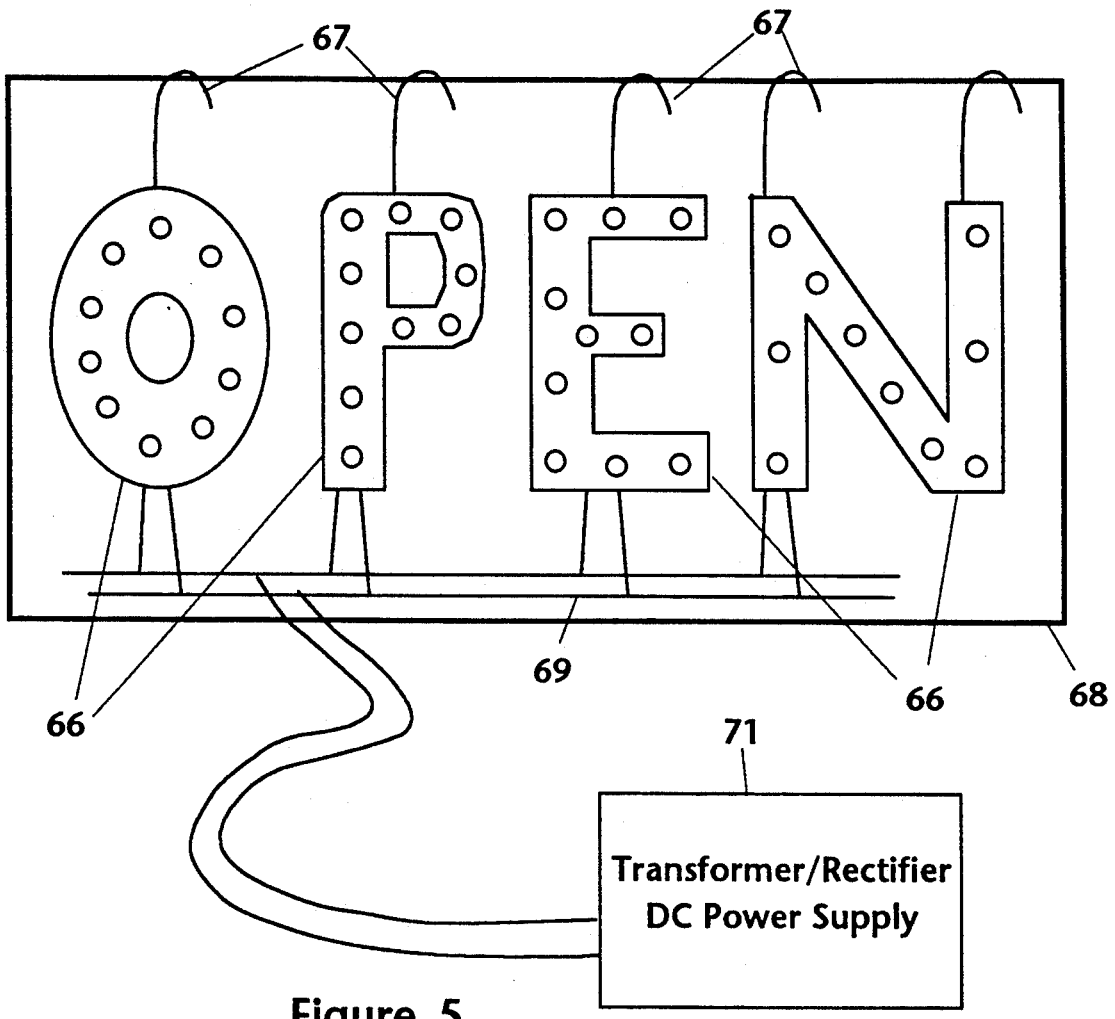
FIG. 5 is a schematic representation of another display embodiment of the present invention.

The invention may be adapted for use in display signs for commercial and industrial use, as shown in FIG. 5. A plurality of letters 66 are provided, each letter having an LED display and associated drive CMOS drive circuit as described herein. Each letter includes an antenna 67 formed as a hook to suspend the letter from a sign frame 68. (The letters may be supported by other means, and the antenna may comprise a non-supporting, conductive member.) The letters 66 are plug-connected to a cable 69 which extends to a DC power supply 71.

As described previously, the LEDs of each letter will flicker in sequence or randomly, according to the array pattern and connection scheme, to create an eye-catching display. The display sign components may be offered commercially as a package including a power supply and cable, a sign frame, and the selected letters to form the desired message. Plugging the letters into the cable, connecting the power supply, and suspending the letters from the frame constitutes the entire sign setup, and the result is an animated sign display that is more attractive and less expensive than most competitive arrangements. Moreover, the letters of the sign are easily changed or interchanged to alter the message, and only those letters that are to be used need to be purchased.

Figure 4:
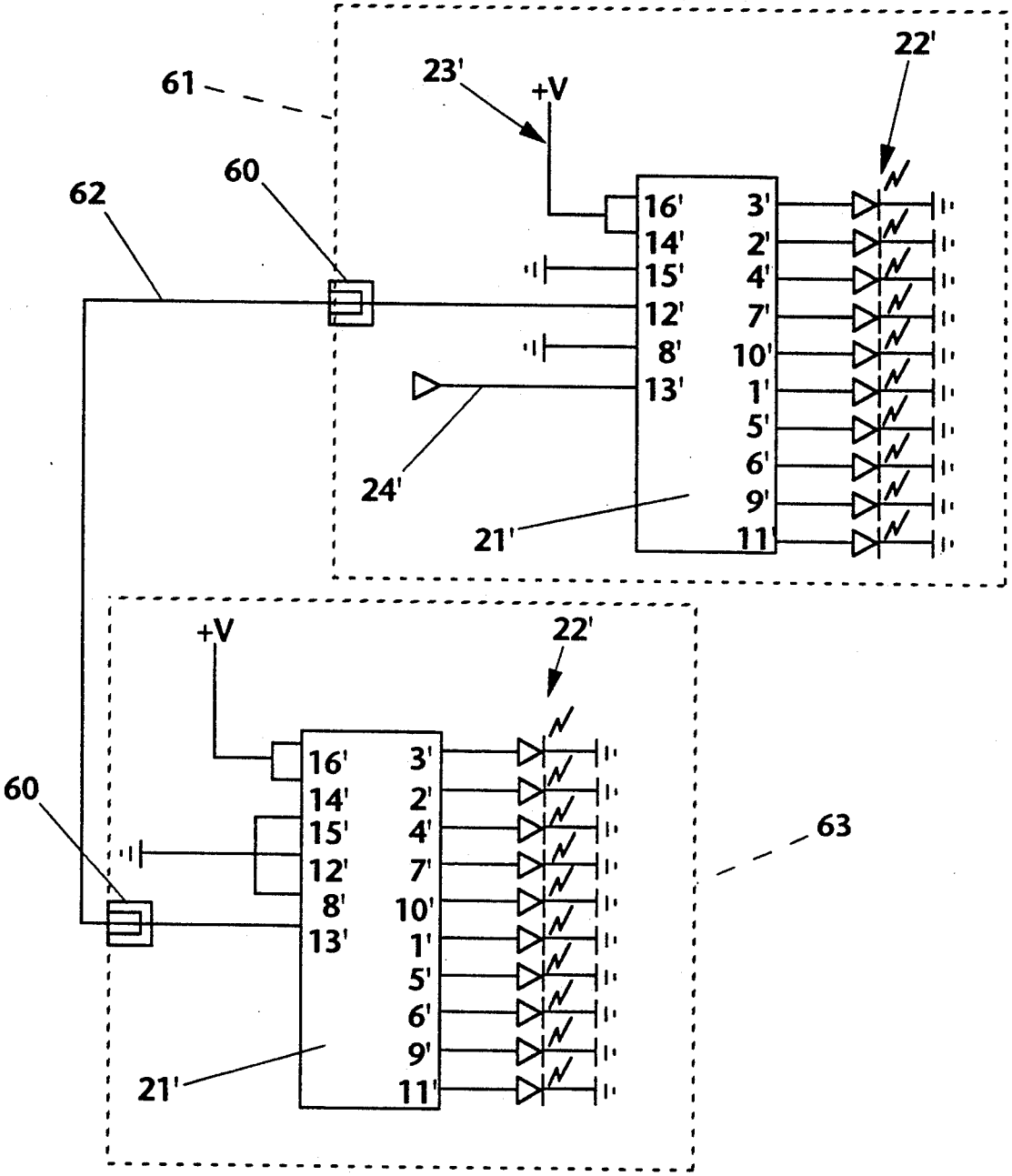
FIG. 4 is a schematic representation of a further embodiment of the invention, in which a plurality of CMOS counter integrated circuits are employed in cascade fashion for an enhanced visual effect.

Another embodiment of the invention, depicted in FIG. 4, includes LED display devices 61 and 63 substantially as described previously, and components common to previous embodiments are labelled with common reference numerals given a prime (') designation. With regard to assembly 61, all connections are as described previously, except that pin 12' is not grounded. Rather, pin 12', the cascade lead, is connected to a plug connector 60 on the exterior of the device 61, and is selectively connected through conductor 62 and through another plug connector 60 on the exterior of the device 63 to the trigger pin 13' of assembly 63. All other connections in assembly 63 remain as before. The cascade pin 12' generates an output once every time a sequence of all output pins 1'-7', 9'-11' is completed. In effect, it produces an output at one-tenth the frequency of the trigger signal input to device 61. This signal is used as a trigger signal for the device 63, which therefore produces a sequential flickering of its LEDs at a much lower rate. If the trigger signal input to assembly 61 is a 60 Hz power hum, the LEDs of assembly 61 will flicker at approximately 6 times per second, and the LEDs of assembly 63 will flicker sequentially at approximately 0.6 times per second. This slower actuation rate is useful for artistic and eye-catching visual effects. For example, the LEDs of the two assemblies 61 and 63 may be intermingled and sequenced, or color coordinated, or the like. This cascade feature may be incorporated in any of the device manifestations described herein, including jewelry, personal items, Christmas tree ornaments, and other displays.

Also, the devices 61 and 63 may be disconnected by separating the plug connectors 60 of each one to achieve individual operation of each device. For example, an antenna lead may be plugged into the connector 60 of device 63 to form a display device as described in FIG. 1*a*.

Figure 6:
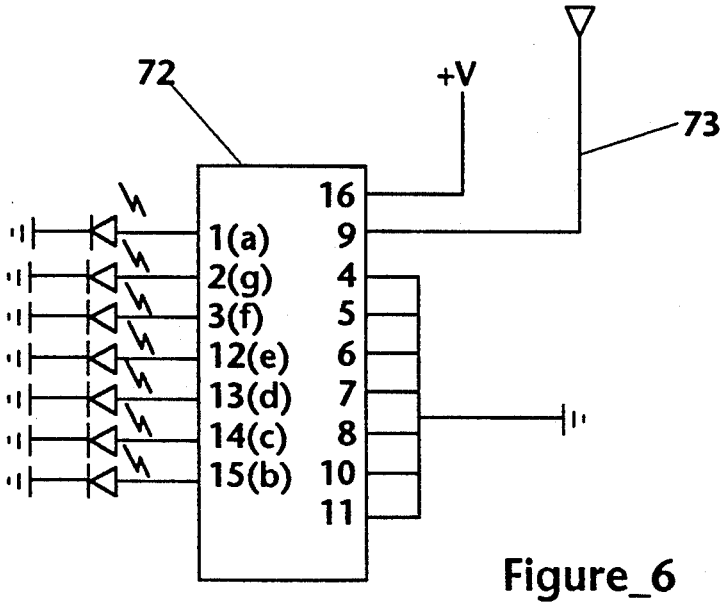
FIG. 6 is a schematic diagram of a further embodiment of the invention for random number generation.

Another embodiment of the invention, depicted in FIG. 6, comprises a random number generator for games or amusement. It includes a CMOS display driver integrated circuit chip 72, such as the 40110 known in the prior art, with the 7 segment outputs (1-3, 12-15) connected to the respective segments of an alphanumeric display. Pin 16 is connected to a positive voltage (at least 3 VDC), pin 9 is connected to antenna 73, and pins 4-8, 10, and 11 are grounded. (Alternatively, the antenna 73 may be connected to pin 7, and pin 9 is grounded instead.) Moving the device into an ambient field will trigger the integrated circuit to cycle through and actuate all of the segment readout possibilities, thus displaying random numbers at a rate too fast for the human eye to discern individual numbers. When the device is moved out of the field and the triggering ceases, the last number displayed is stored by the device 72 and maintained as a display on the alphanumeric readout. Thus a number between 0 and 9 is randomly selected and displayed.

It may be noted that LEDs have a life expectancy of approximately 100,000 hours of operation, implying that the displays of the present invention will last a lifetime of normal use.

In any of the displays and ornaments described with regard to FIGS. 1-5, additional LEDs may be added and connected to be illuminated continuously. These LEDs may be used to demarcate fixed features of the image or logo being displayed, or may be used in combination with sequentially flickering LEDs of differing color to create varying color effects.

Although the invention has been described with reference to CMOS integrated circuit counters, it may be appreciated that any integrated circuit having sufficient sensitivity and low trigger signal power requirements may be used within the scope of the invention.

I claim:

1. An electronic display for amusement and ornamentation, including a plurality of LEDs, an integrated circuit counter device including a trigger input having a high signal sensitivity, a DC power supply connected to said integrated circuit counter device, said integrated circuit counter device having a plurality of sequentially activated outputs, each of said integrated circuit outputs connected directly to one of said plurality of LEDs, an antenna conductor means connected directly to said trigger input of said integrated circuit counter device and disposed to receive ambient electromagnetic fields in the vicinity of said display and to generate a corresponding AC signal to actuate said trigger input of said integrated circuit counter device, said antenna conductor means comprising a hook secured to said display for suspending said display from an object.

2. An electronic display for amusement and ornamentation, including first and second pluralities of LEDs, first and second integrated circuit counter devices, each including a trigger input having a high signal sensitivity, a DC power supply connected to each integrated circuit counter device, each integrated circuit counter device having a plurality of sequentially activated outputs, each of said sequentially activated outputs of said first integrated circuit connected directly to one of said first plurality of LEDs, each of said sequentially activated outputs of said second integrated circuit connected directly to one of said second plurality of LEDs, antenna conductor means connected directly to said trigger input of said first integrated circuit counter device and disposed to receive ambient electromagnetic fields in the vicinity of said display and to generate a corresponding AC signal to actuate said trigger input of said first integrated circuit counter device, said first integrated circuit counting device including a cascade output, and said second integrated circuit device including a trigger input connected to said cascade output of said first integrated circuit device, whereby said second integrated circuit counter device counts at a rate that is an integral divisor of the counting rate of said first integrated circuit counter device.

3. The electronic display of claim 1, wherein said display is incorporated in an item of personal jewelry.

4. The electronic display of claim 1, wherein said display is incorporated in a Christmas tree ornament.

5. The electronic display of claim 2, wherein each of said pluralities of LEDs is disposed to delineate a letter or number, and means for grouping said pluralities of LEDs to form a message.

6. The electronic display of claim 2, wherein said antenna conductor means comprises a hook secured to said display for suspending said ornament from an object.

7. A combination light display, including a plurality of LEDs, an integrated circuit counter device including a trigger input having a high signal sensitivity, a DC power supply connected to said integrated circuit counter device, said integrated circuit counter device having a plurality of sequentially activated outputs, each of said integrated circuit outputs connected directly to one of said plurality of LEDs, antenna conductor means connected directly to said trigger input of said integrated circuit counter device and disposed to receive ambient electromagnetic fields in the vicinity of said display and to generate a corresponding AC signal to actuate said trigger input of said integrated circuit counter device and operate said LEDs in a serially-actuated, flickering mode.

8. The combination light display and Christmas tree ornament of claim 7, wherein said antenna conductor means comprises a hook secured to said ornament for suspending said ornament from an object.

* * * * *